US009111528B2

(12) United States Patent
Van Dongen

(10) Patent No.: US 9,111,528 B2
(45) Date of Patent: Aug. 18, 2015

(54) MATRIX DECODER FOR SURROUND SOUND

(75) Inventor: Charlie Corneles Van Dongen, Frankston (AU)

(73) Assignee: Reality IP Pty Ltd, Caulfield, Victoria (AU)

( * ) Notice: Subject to any disclaimer, the term of this patent is extended or adjusted under 35 U.S.C. 154(b) by 753 days.

(21) Appl. No.: 13/379,065

(22) PCT Filed: Dec. 9, 2010

(86) PCT No.: PCT/AU2010/001666

§ 371 (c)(1),
(2), (4) Date: Mar. 8, 2012

(87) PCT Pub. No.: WO2011/069205

PCT Pub. Date: Jun. 16, 2011

(65) Prior Publication Data

US 2012/0163607 A1 Jun. 28, 2012

(30) Foreign Application Priority Data

Dec. 10, 2009 (AU) ..... 2009906030

(51) Int. Cl.
*H04R 5/00* (2006.01)
*G10L 19/008* (2013.01)
*H04S 3/02* (2006.01)

(52) U.S. Cl.
CPC *G10L 19/008* (2013.01); *H04S 3/02* (2013.01)

(58) Field of Classification Search
CPC ..... G10L 19/008; H04S 3/02; H04S 2400/01
USPC ..... 381/22, 23, 17, 18, 19, 20, 21; 375/355, 375/360, 361; 341/70, 71; 704/500, 503; 455/226.1, 226.2
See application file for complete search history.

(56) References Cited

U.S. PATENT DOCUMENTS

| | | | | |
|---|---|---|---|---|
| 5,727,068 | A * | 3/1998 | Karagosian et al. | 381/22 |
| 6,198,827 | B1 | 3/2001 | Waller, Jr. | |
| 7,107,211 | B2 * | 9/2006 | Griesinger | 704/228 |
| 2003/0210794 | A1 | 11/2003 | Sato et al. | |
| 2007/0297519 | A1 | 12/2007 | Thompson et al. | |

* cited by examiner

*Primary Examiner* — Paul S Kim

(57) ABSTRACT

A decoder and decoding method for use in surround sound system wherein at least four audio input signals representing an original sound field are encoded into two channel signals and said encoded signals are decoded into at least four audio output signals corresponding to the four audio input signals and have an amplitude ratio and a phase relationship. The decoder and method including means for: compensating the said encoded signals for variations in perceived loudness relative to frequency associated with the encoded two channel signals due to non linearity in human hearing response at least at some frequencies; producing steering signals in responsive to the phase relationship of the said compensated signals; decoding said encoded signals to produce audio output signals corresponding to audio input signals by varying at least the amplitude ratio of said encoded signals contained in each of the output signals in response to said steering signals.

21 Claims, 8 Drawing Sheets

MATRIX DECODER FOR SURROUND SOUND

FIELD OF THE INVENTION

The present invention relates to an improved matrix decoder for surround sound. The matrix decoder may be associated with a surround sound system wherein at least four audio input signals representing an original sound field are encoded into two channels and the two channels are decoded into at least four channels corresponding to the four audio input signals.

BACKGROUND OF THE INVENTION

In a multi-channel system as described above four channels of audio signals are obtained from an original sound field and are encoded by an encoder into two channels. The encoded two channels may be recorded on recording media such as CD, DVD or the like or broadcast via stereo TV or FM radio. The encoded two channels may be reproduced from the recording media or broadcast and decoded by means of a matrix decoder back into four channels approximating the four channels of audio signals obtained from the original sound field. The decoded signals may be applied to four speakers to reproduce the original sound field through suitable amplifiers.

Because the four channels of audio signals are encoded into two channels by the encoder it may not be possible for the decoder to reproduce signals that are identical to the original four audio signals. As a result, cross-talk between adjacent channels may increase so that it may not be possible to obtain a reproduced sound field that is identical to the original sound field.

The present invention may provide a matrix decoder having improved separation between respective channels including between front and rear channels and between left and right channels.

The present invention may provide a matrix decoder capable of alleviating cross-talk between the respective channels to thereby improve the quality of the reproduced sound field.

The present invention may provide a matrix decoder capable of improving image stability in the reproduced sound field.

SUMMARY OF THE INVENTION

According to one aspect of the present invention there is provided a decoder for use in a surround sound system wherein at least four audio input signals (FL, FR, RL, RR) representing an original sound field are encoded into two channel signals (L, R) and said encoded two channel signals are decoded into at least four audio output signals (FL', FR', RL', RR') corresponding to said four audio input signals, said encoded two channel signals having an amplitude ratio and a phase relationship, said decoder including:

first filter means connected to receive said encoded two channel signals for compensating for variations in perceived loudness relative to frequency associated with said encoded two channel signals due to non linearity in human hearing response at least at some frequencies;

a control unit responsive to the phase relationship of said compensated two channel signals for producing steering signals; and matrix means connected to receive said compensated two channel signals for decoding said encoded two channel signals to produce said audio output signals corresponding to said audio input signals, said matrix means including means responsive to said steering signals for varying at least the amplitude ratio of said encoded two channel signals contained in each of said output signals.

The first filter means may include an equal loudness weighting contour. In one form the first filter means may include an ITU-R 468 weighting contour and/or a pink noise contour. In another form the first filter means may include an A-weighting or Fletcher-Munson contour.

The decoder may include an RMS detector connected to receive the two channel signals for determining a root mean square (RMS) value associated with the two channel signals. The RMS detector may include means for applying a first attack time constant and a second decay time constant in determining the RMS value. The first attack time constant may be substantially faster than the second decay time constant. The decoder may include a second filter means connected to receive the two channel signals for adjusting amplitude of the signals to correct for logarithmic sensitivity of human hearing response.

According to another aspect of the present invention there is provided a decoding method for use in a surround sound system wherein at least four audio input signals (FL, FR, RL, RR) representing an original sound field are encoded into two channel signals (L, R) and said encoded two channel signals are decoded into at least four audio output signals (FL', FR', RL', RR') corresponding to said four audio input signals, said encoded two channel signals having an amplitude ratio and a phase relationship, said method including:

compensating said encoded two channel signals for variations in perceived loudness relative to frequency associated with said encoded two channel signals due to non linearity in human hearing response at least at some frequencies;

producing steering signals in response to the phase relationship of said compensated two channel signals; and decoding said encoded two channel signals to produce said audio output signals corresponding to said audio input signals by varying at least the amplitude ratio of said encoded two channel signals contained in each of said output signals in response to said steering signals.

DESCRIPTION OF A PREFERRED EMBODIMENT

A preferred embodiment of the present invention will now be described with reference to the accompanying drawings wherein.

To facilitate an understanding of the present invention the principles of a "4-2-4" matrix playback system and an encoder is described below with reference to FIGS. 1 and 2 of the accompanying drawings.

Figure 1:
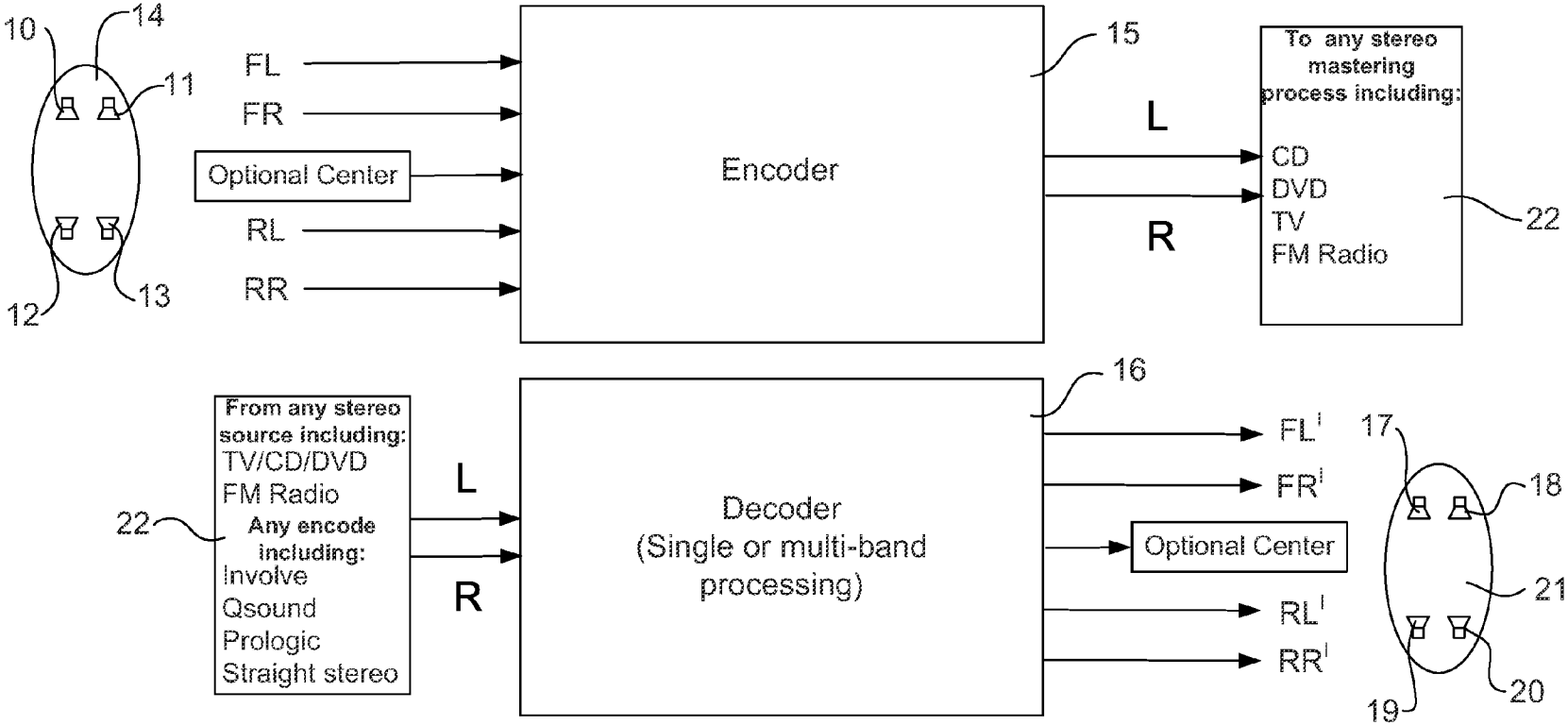
FIG. 1 is a block diagram showing principles of a "4-2-4" matrix system.
Figure 2:
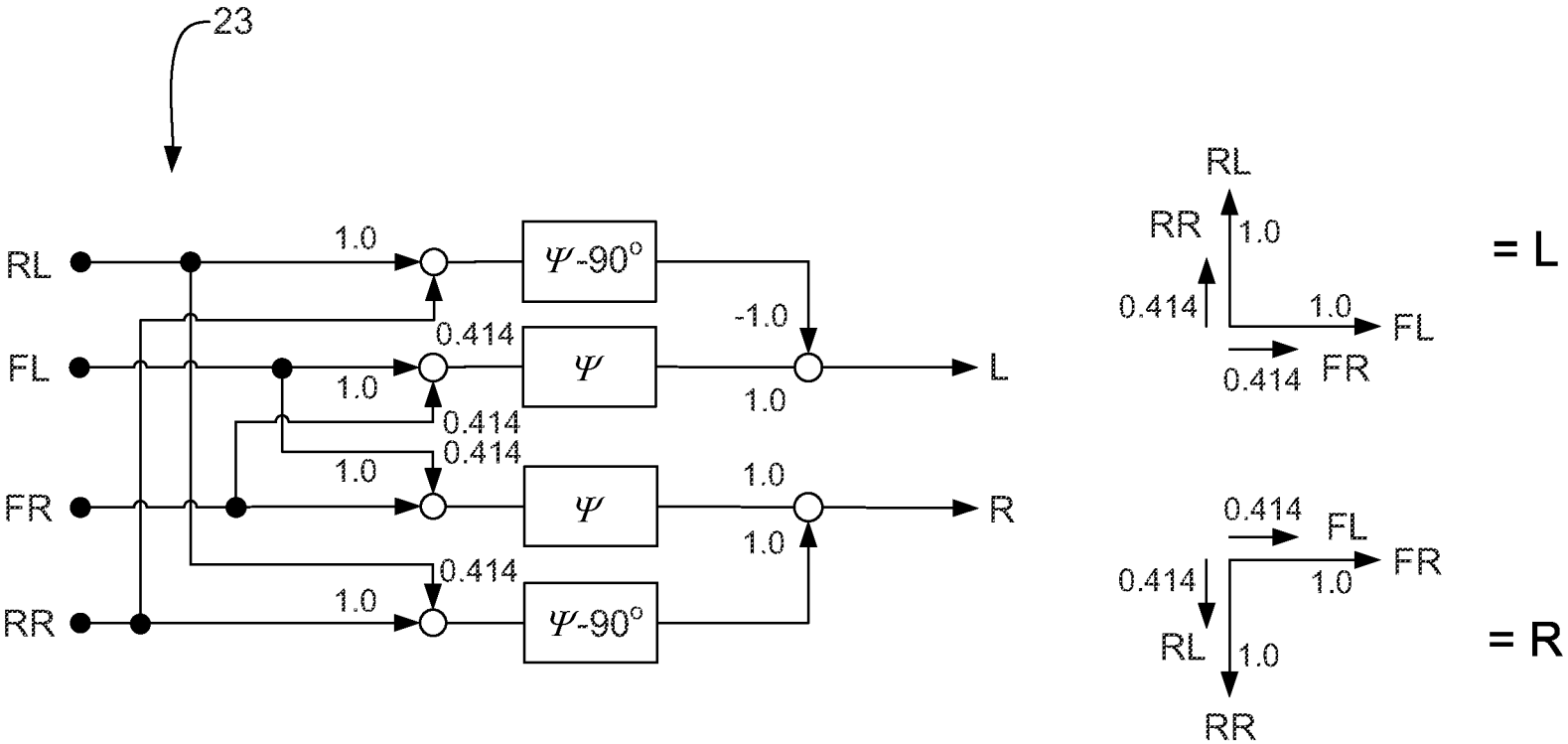
FIG. 2 shows a configuration of an encoder.

In the system shown in FIG. 1, four microphones 10, 11, 12 and 13 are installed in an original sound field 14 in order to produce four channel audio signals FL (front-left), FR (front-right), RL (rear-left) and RR (rear-right) respectively. An optional centre channel may also be produced. The four channel audio signals are supplied to encoder 15 to be transformed or encoded into two signals L and R. The outputs L and R from encoder 15 are applied to a decoder 16 to be transformed or decoded into reproduced four channel signals FL', FR', RL' and RR' approximating the original four channel signals FL, FR, RL and RR. Decoder 16 may include single or multi-band processing as described below. The reproduced four channel signals may be applied through amplifiers (not shown) to four loud speakers 17, 18, 19 and 20 located in a listening space 21 to provide a multi-channel sound field that more closely approximates the original sound field 14 when compared to a prior art two channel system.

A variety of two channel systems 22 including CD, DVD, TV, FM radio, etc. may be used to capture or store outputs L and R from encoder 15 and to supply the captured or stored outputs to decoder 16. In one example outputs L and R from encoder 15 may be recorded on a storage medium such as a CD, DVD or magnetic tape and the outputs from the storage medium may be applied to decoder 16. According to another example the outputs L and R from encoder 15 or the outputs reproduced from the recording medium may be transmitted to decoder 16 via a stereo TV or an FM stereo radio broadcasting system.

Encoder 15 may include any conventional or known encoder including Q sound, Prologic or conventional stereo. In one form encoder 15 shown in FIG. 1 may be configured as shown in FIG. 2 wherein audio signals FL and FR produced by microphones 10 and 11 disposed in the front of original sound field 14 and audio signals RL and RR produced by microphones 12, 13 disposed in the rear of original sound field 14 are applied to a matrix circuit 23.

Matrix circuit 23 includes a plurality of adders/multipliers and phase shifters arranged to produce L and R output signals as follows:

$$L=FL+kFR+jRL+jkRR$$

$$R=FR+kFL-jRR-jkRL$$

wherein k denotes a transformation or matrix constant generally having a value approximately 0.414 and j denotes a 90 degree phase shift. The phase shifters may provide a substantially consistent phase shift over the entire audio frequency band. The four channel signals FL', FR', RL' and RR' may be reproduced by a conventional decoder having the same fixed matrix constant k. However, it may be shown that when k=0.414, separations between channel FL' and adjacent channels FR' and RL' are respectively equal to −3 dB and separation between the channels FL' and RR' in a diagonal direction equals-.infin. dB. Because the separation between adjacent channels equals −3 dB it is not possible to enjoy stereo playback of four channels with a sufficiently large directional resolution.

Figure 3:
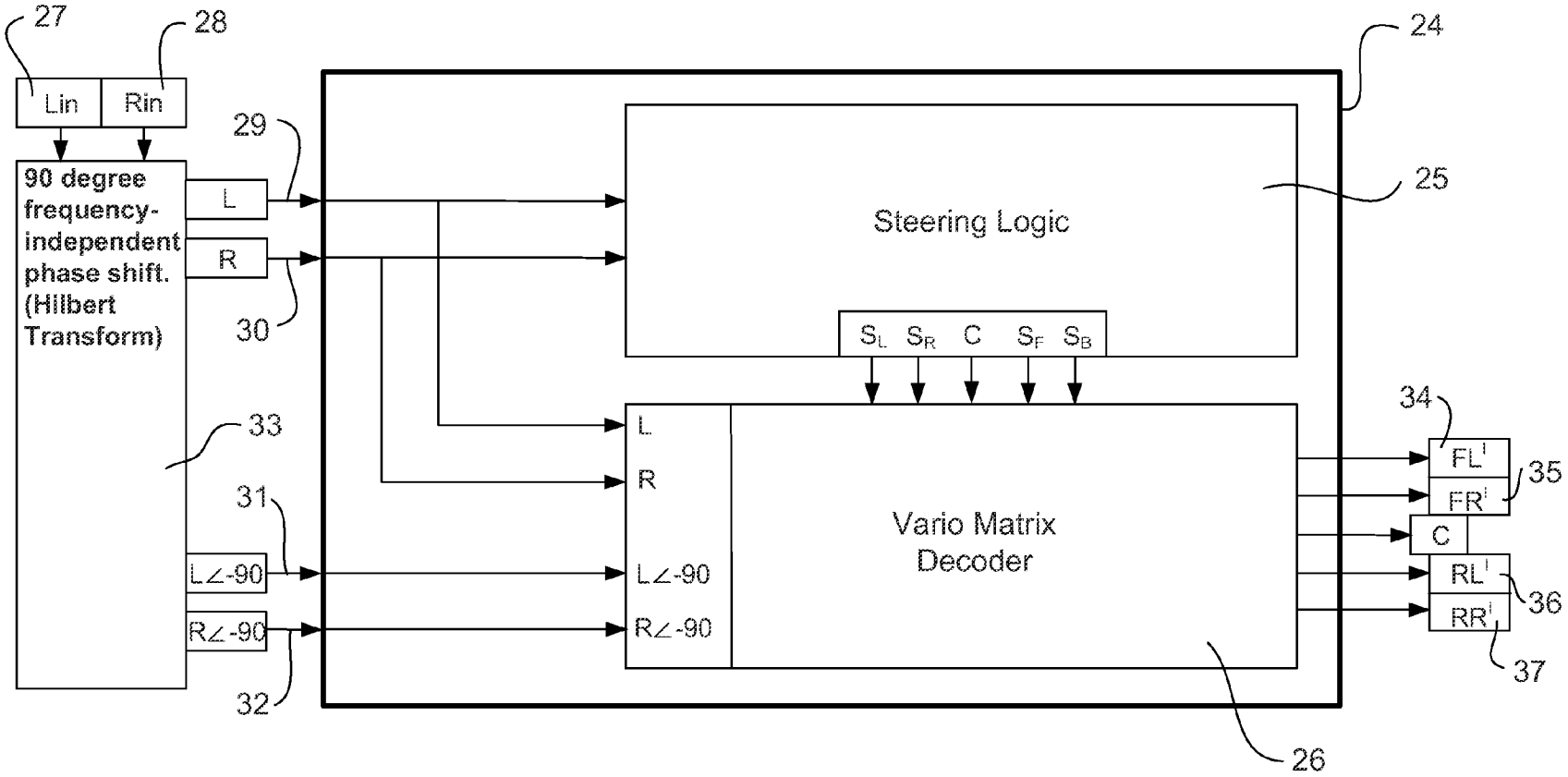
FIG. 3 shows a block diagram of a decoder according to the present invention.

FIG. 3 shows a block diagram of an improved decoder including a variable matrix 24 having control unit 25 and decoder unit 26 and employing matrix coefficients $S_L$, $S_R$, $S_F$, $S_B$ the magnitudes of which may be controlled in accordance with the phase difference between two channel signals L and R.

In the decoder shown in FIG. 3, the two channel signals L and R are applied to input terminals 27 and 28 of the decoder from a two-channel media source and hence to input terminals 29 and 30 of variable matrix 24. Input terminals 27 and 28 are also coupled to input terminals 31 and 32 of variable matrix 24 via 90 degree phase shift circuit 33. Variable matrix 24 operates to decode or dematrix the two channel signals L and R to produce four channel signals at its output terminals 34, 35, 36 and 37. Control unit 25 provides steering control signals $S_L$, $S_R$, $S_F$, and $S_B$ to decoder unit 26 in accordance with the phase difference between two-channel signals L and R. The magnitudes of the steering control signals $S_L$, $S_R$, $S_F$, and $S_B$ from control unit 25 may vary in opposite directions in proportion to the phase difference between signals L and R. Control signal $S_F$ may be used to control the matrix coefficient related to the front channels and control signal $S_B$ may be used to control the matrix coefficient related to the rear channels. Similarly control signal $S_R$ may be used to control the matrix coefficient related to the right channels and control signal $S_L$ may be used to control the matrix coefficient related to the left channels. Where the phase difference between signals L and R is near zero, for instance, the control signal $S_F$ operates to decrease the matrix coefficient related to the front channels thus enhancing separation between the front channels. On the other hand, control signal $S_B$ operates to increase the matrix coefficient related to the rear channels to reduce separation between rear channels. Concurrently therewith signal levels of the front channels may be increased and those of the rear channels may be decreased to improve separation between the front and rear channels.

The control unit 25 may include a phase discriminator for detecting a phase difference between signals L and R or a comparator for detecting a phase relationship between signals L and R in terms of the difference in the levels of a sum signal (L+R) and a difference signal (L−R). A reason for controlling the matrix coefficient associated with the front and rear channels by detecting the phase relationship between signals L and R is that humans have a keen sensitivity to detect the direction of a large sound but sensitivity for a small sound coexisting with the large sound may be relatively poor. Consequently, where there is a large sound in the front and a small sound in the rear playback of four channels may be more efficient if separation between the front channels is enhanced and separation between the rear channels is reduced. In contrast, where a small sound exists in the front and a large sound in the rear playback of four channels may be more efficient if separation between the rear channels is enhanced and separation between the front channels is reduced.

Where a large sound is present in the front and a small sound is present in the rear, that is, where FL, FR>>RL, RR, signals L and R may have substantially the same phase. This means that the level of a sum signal (L+R) may be higher than that of a difference signal (L−R).

Conversely, where a large sound is present in the rear while a small sound is present in the front, that is, where FL, FR<<RL, RR, signals L and R have opposite phase. In such a case, the level of the sum signal (L+R) may be lower than the level of the difference signal (L−R). For this reason, it may be possible to detect phase relationship between signals L and R by either a phase discriminator or a comparator.

Figure 4:
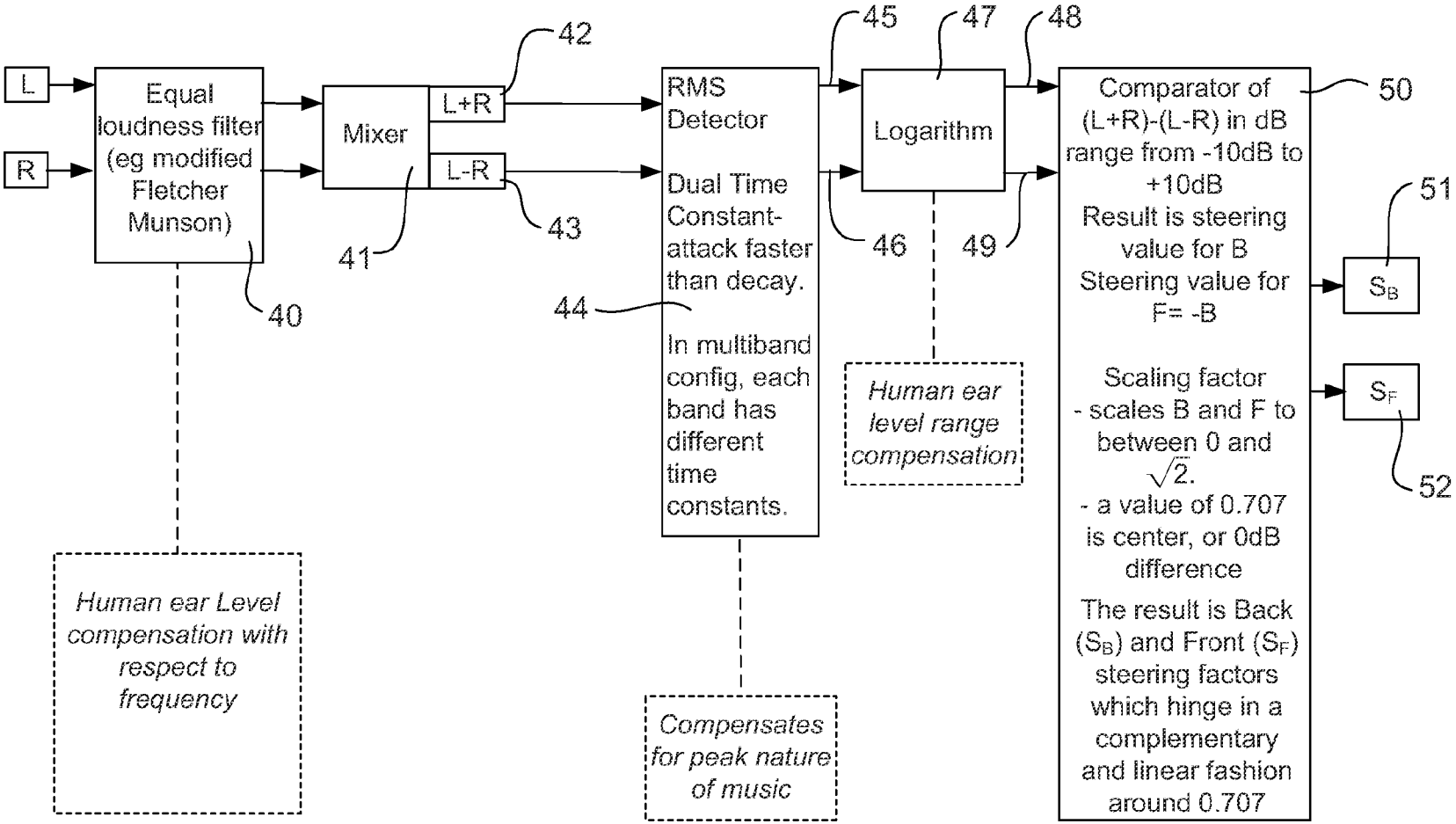
FIG. 4 shows a block diagram of front-back steering logic associated with a decoder.

FIG. 4 is a block diagram of a steering logic circuit for producing front/back steering values $S_F$, $S_B$. The steering logic circuit includes an equal loudness weighting filter 40 such as a modified Fletcher Munson/A-weighting or ITU-R 468 filter for providing compensation for variations in perceived loudness relative to frequency due to non linearity in human hearing response at least at some frequencies. The equal loudness weighting filter may be modified to include a characteristic similar to a pink noise (1/f) weighting at low frequencies, to further attenuate high amplitude low audibility sounds that may otherwise unduly influence the steering logic circuit.

One reason for the compensation is that sounds in a 2-4 KHz octave appear loudest to the ear whilst sounds at other frequencies appear attenuated. A-weighting filters are sometimes used for the purpose of compensation. However, a pink noise filter is preferred for music content over an A-weighting filter because the latter is mainly valid for pure tones and relatively quiet sounds.

Pink noise is also known as 1/f noise, wherein power spectral density is inversely proportional to frequency. A pink noise contour gives greater attenuation at low frequencies than a Fletcher Munson/A-weighting or ITU-R 468 weighting filter based on the fact that for equal power, amplitude is inversely proportional to frequency. Use of a pink noise contour may further reduce dominance of low frequency sounds (high amplitude but low audibility) in calculating steering logic values, which are based on amplitude, and results in better placement of sound information that may be important for correct image generation.

The steering logic circuit includes a mixer/comparator 41 for adding the compensated channel signals L and R to produce a sum signal (L+R) 42 and for subtracting the two channel signals L and R to produce a difference signal (L−R) 43. The sum and difference signals 42, 43 are applied to RMS detector 44. RMS detector 44 is adapted to compensate for the peak nature of music content. The averaging time constant over which RMS detector 44 measures a 'mean' value of a music signal preferably includes a first or 'attack' time constant and a second or 'decay' time constant. The 'attack' time constant may be substantially faster than the 'decay' time constant. In one example the attack time constant may be 20 mS and the decay time constant may be 50 mS for a full range RMS detector. In some embodiments an RMS detector including a single time constant may be used.

RMS detected outputs 45, 46 are applied to logarithmic amplifier 47 to produce outputs 48, 49 proportional to log|L+R| and log|L−R| respectively. Logarithmic amplifier 47 is adapted to correct for logarithmic sensitivity of human hearing response to sound that spans a range of signal amplitudes or levels. Output signals 48, 49 are applied to comparator 50 to produce a steering value $S_B$ based on a comparison of signals 48 and 49 and a steering value $S_F=-S_B$. The steering values $S_F$, $S_B$ may be scaled to values between 0 and 1.414 representing a ±10 dB range between the signals 48 and 49 including an average or centre value of (0+1.414)/2=0.707 representing a 0 dB difference between the signals 48 and 49. Comparator 50 may produce at its outputs 51, 52 front and back steering factors $S_F$, $S_B$ that hinge in a complementary and linear fashion around the centre value 0.707 representing 0 dB difference between signals 48 and 49.

Figure 5:
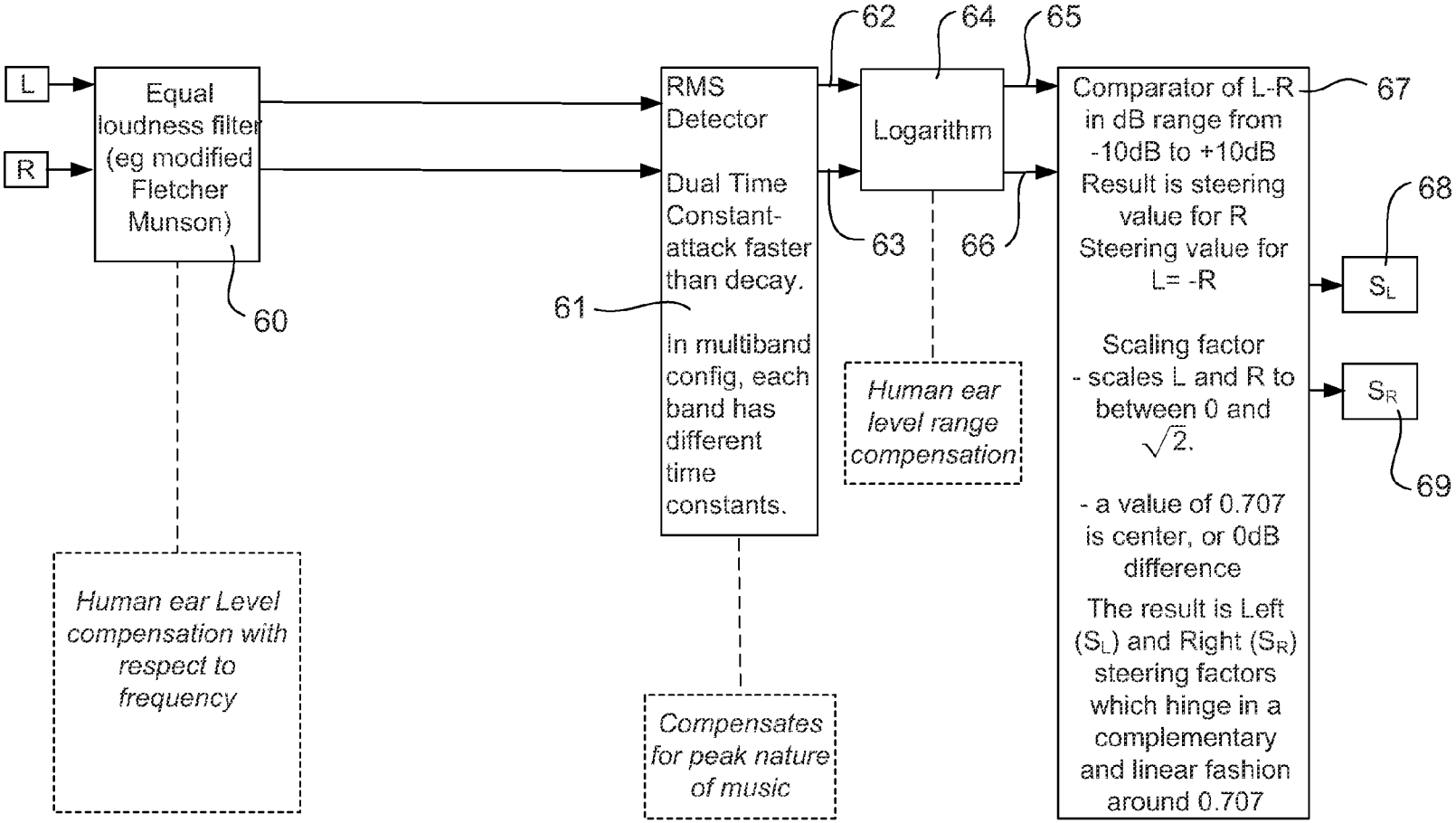
FIG. 5 shows a block diagram of left-right steering logic associated with a decoder.

FIG. 5 is a block diagram of a steering logic circuit producing left/right steering values $S_L$, $S_R$. The steering logic circuit includes an equal loudness weighting filter 60 such as a modified Fletcher Munson/A weighting or ITU-R 468 filter. Weighting filter 60 may be similar to weighting filter 40 and may be adapted to compensate for non linearity in human hearing response as described above.

The steering logic circuit includes a RMS detector 61. RMS detector 61 may be similar to RMS detector 44 and may be adapted to compensate for the peak nature of music content as described above. RMS detected outputs 62, 63 are applied to logarithmic amplifier 64 to produce outputs 65, 66 proportional to log|L| and log|R| respectively. Logarithmic amplifier 64 may be similar to logarithmic amplifier 47 described above and is adapted to correct for logarithmic sensitivity of human hearing response to sound that spans a range of signal amplitudes or levels. Output signals 65, 66 are applied to comparator 67 to produce a steering value $S_R$ based on a comparison of signals 65 and 66 and a steering value $S_L=-S_R$. The steering values $S_L$, $S_R$ may be scaled to values between 0 and 1.414 representing a ±10 dB range between the signals 65 and 66 including an average or centre value of (0+1.414)/2=0.707 representing a 0 dB difference between the signals 65 and 66. Comparator 67 may produce at its outputs 68, 69 left and right steering factors $S_L$, $S_R$ that hinge in a complementary and linear fashion around the centre value 0.707 representing 0 dB difference between signals 65 and 66.

Figure 6:
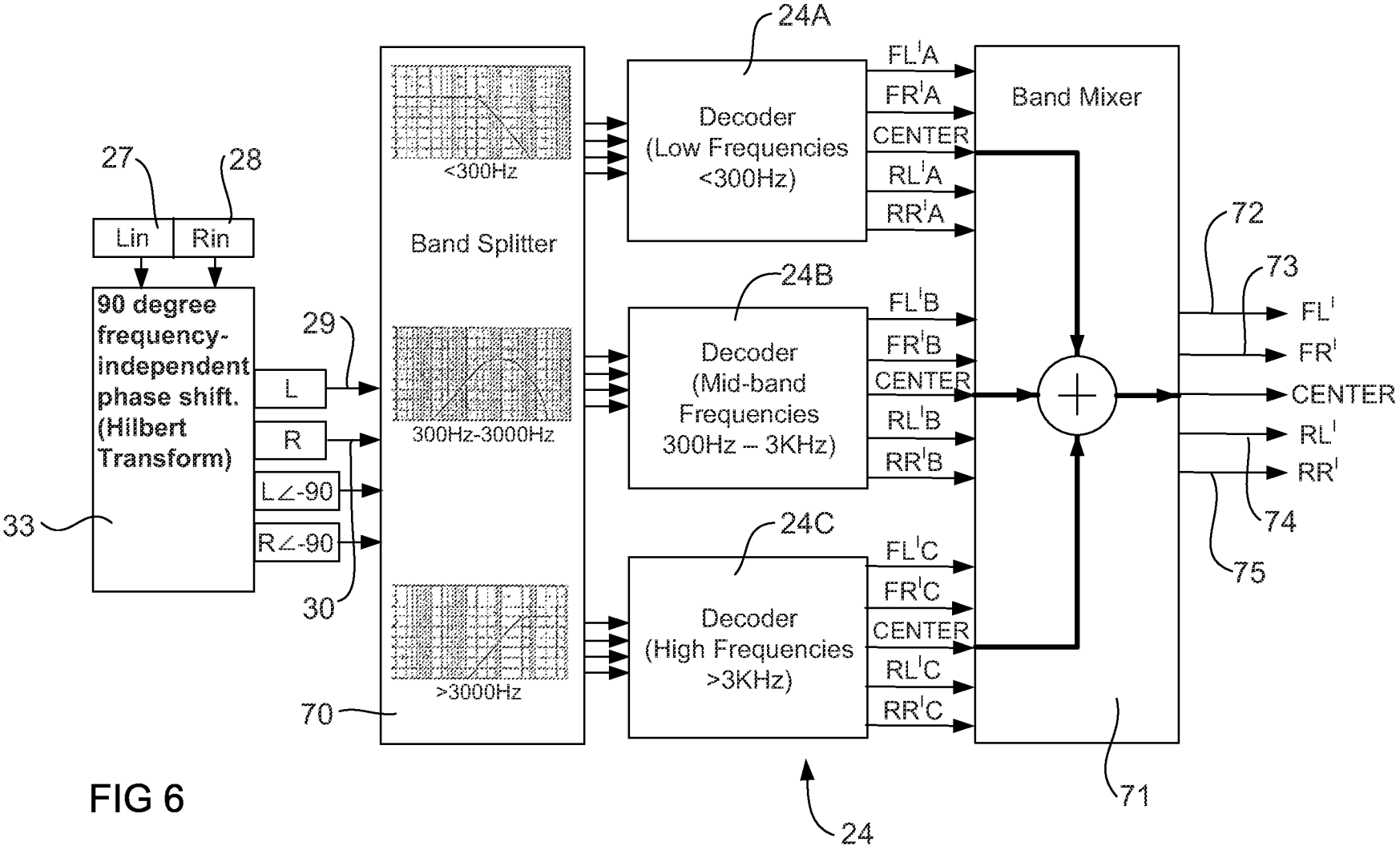
FIG. 6 shows a block diagram of a multi-band decoder according to the present invention.

Because it may be difficult to optimize values of steering control signals $S_F$, $S_B$, $S_L$, $S_R$ for all frequencies present in music content, high and low frequency sounds may be steered differently resulting in an unnatural reproduction of sounds for the listener. To mitigate against this the encoder of the present invention may include a multi-band modification as shown in FIG. 6. FIG. 6 shows a multi-band decoder wherein the audible spectrum may be split into 3 separate bands via band splitter 70. The bands include a low frequency band A below 300 Hz, a mid-frequency band B between 300-3 KHz and a high frequency band C above 3 KHz. Band splitter 70 may be interposed between 90 degree phase shift circuit 33 (refer FIG. 3) and variable matrix decoder 24. A separate matrix decoder 24A, 24B, 24C may be used to produce a set of four channel output signals FL', FR', RL' and RR' for each frequency band A, B, C. The four channel output signals for each band may be subsequently combined via band mixer 71. For example the output FL' may be obtained by combining contributions FL'A, FL'B and FL'C produced by matrix decoders 24A, 24B and 24C respectively.

When RMS detectors 44 and 61 are used in a multiband decoder the attack time constant may be 30 mS and the decay time constant may be 60 mS for band A. The attack time constant may be 10 mS and the decay time constant may be 30 mS for band B. The attack time constant may be 1 mS and the decay time constant may be 5 mS for band C.

The contributions produced by matrix decoders 24A, 24B and 24C may be similarly combined to produce full band decoded outputs FL', FR', RL' and RR' for the multi band decoder at its output terminals 72, 73, 74, 75 respectively.

Figure 7:
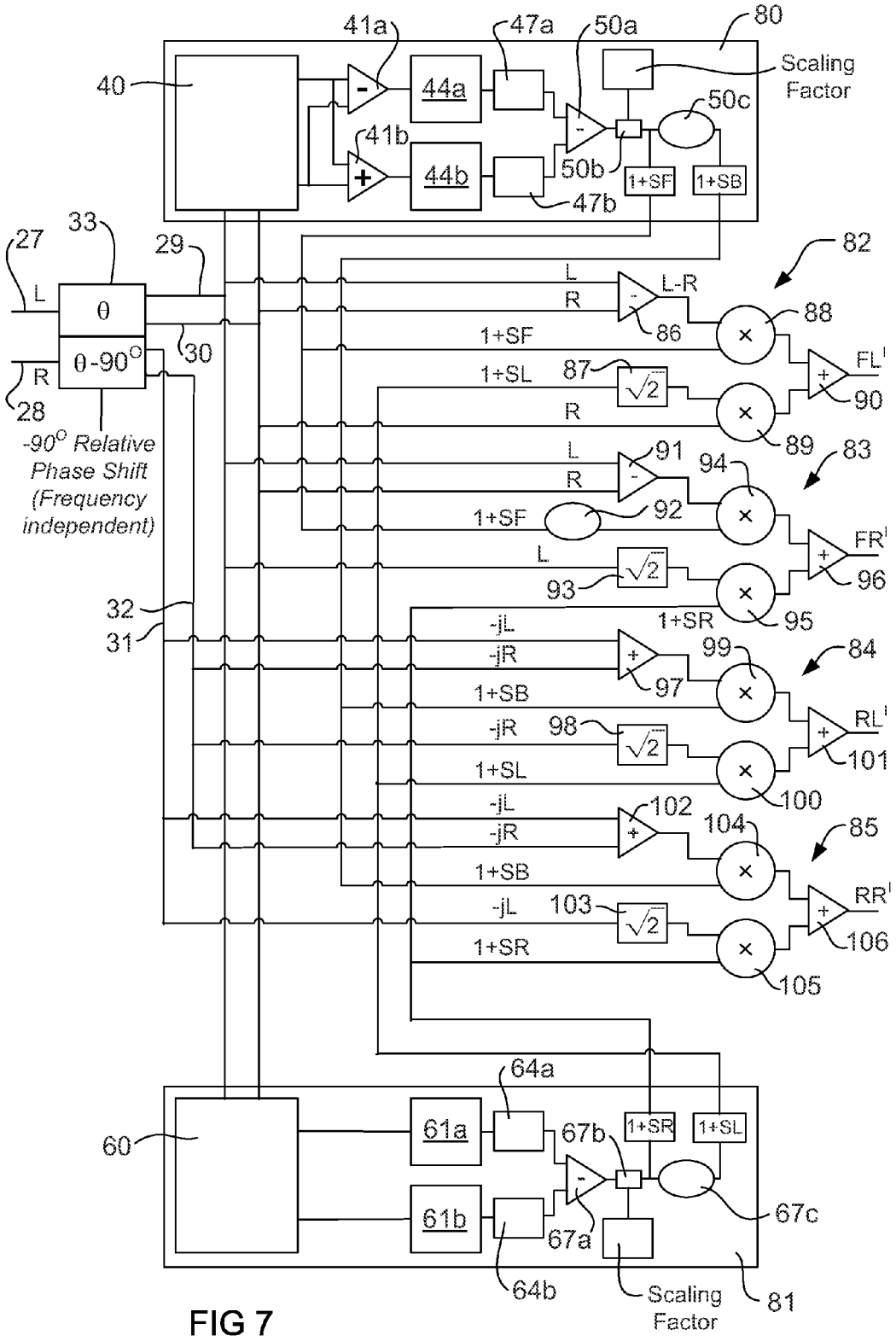
FIG. 7 shows a circuit diagram a matrix decoder according to one embodiment of the present invention.

FIG. 7 shows a circuit diagram of a matrix decoder including a steering logic circuit 80 for producing front/back steering values $S_F$, $S_B$, a steering logic circuit 81 for producing left/right steering logic and matrix circuits 82 to 85. Steering logic circuit 80 includes an equal loudness weighting filter 40 such as a modified Fletcher Munson filter, comparator 41, RMS detector 44, logarithmic amplifier 47 and comparator 50 as described above with reference to FIG. 4. Comparator 41 includes parts 41*a*, 41*b* for producing difference (L−R) and sum (L+R) signals respectively as described above. RMS detector 44 has dual time constants and includes parts 44*a*, 44*b* for RMS detecting the difference and sum signals respectively. Logarithmic amplifier 47 includes parts 47*a*, 47*b* for correcting the RMS detected difference and sum signals respectively. Comparator 50 includes parts 50*a*, 50*b* and 50*c* for comparing the outputs of parts 47*a*, 47*b* and for applying a scaling factor to provide steering factor $S_F$ and for inverting the latter to provide steering factor $S_B$.

Steering logic circuit 81 includes an equal loudness weighting filter 60 such as a modified Fletcher Munson filter, RMS detector 61, logarithmic amplifier 64 and comparator 67 as described above with reference to FIG. 5. RMS detector 61 has dual time constants and includes parts 61*a*, 61*b* for RMS detecting the left and right signals respectively. Logarithmic amplifier 64 includes parts 64*a*, 64*b* for correcting the RMS detected left and right signals respectively. Comparator 67 includes parts 67*a*, 67*b* and 67*c* for comparing the outputs of parts 64*a*, 64*b* and for applying a scaling factor to provide steering factor $S_R$ and for inverting the latter to provide steering factor $S_L$.

Matrix circuit 82 includes difference amplifier 86, $\sqrt{2}$ scaler 87, multipliers 88, 89 and summing amplifier 90. The output FL' appearing at the output terminal of summing amplifier 90 and hence at the output of matrix circuit 82 is given by the following equation:

$$FL'=(1+S_F)(L-R)+(1+S_L)\sqrt{2}R$$

Matrix circuit 83 includes difference amplifier 91, inverter 92, $\sqrt{2}$ scaler 93, multipliers 94, 95 and summing amplifier 96. The output FR' appearing at the output terminal of summing amplifier 96 and hence at the output of matrix circuit 83 is given by the following equation:

$$FR'=(1+S_R)\sqrt{2}L-(1+S_F)(L-R)$$

Matrix circuit 84 includes difference amplifier 97, $\sqrt{2}$ scaler 98, multipliers 99, 100 and summing amplifier 101. The output RL' appearing at the output terminal of summing amplifier 101 and hence at the output of matrix circuit 84 is given by the following equation:

$$RL'(1+S_L)\sqrt{2}jR-(1+S_B)j(L+R)$$

Matrix circuit 85 includes difference amplifier 102, $\sqrt{2}$ scaler 103, multipliers 104, 105 and summing amplifier 106. The output RR' appearing at the output terminal of summing amplifier 106 and hence at the output of matrix circuit 85 is given by the following equation:

$$RR'=(1+S_R)j\sqrt{2}L-(1+S_B)j(L+R)$$

Figure 8A:
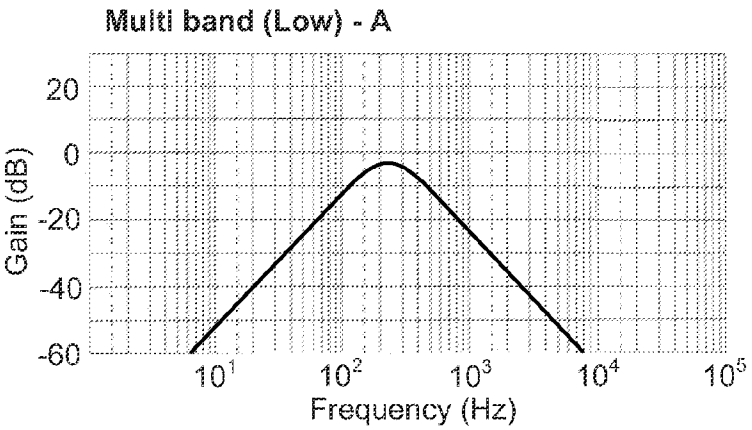
FIGS. 8A to 8D show examples of equal loudness response curves associated with the first filter means.
Figure 8B:
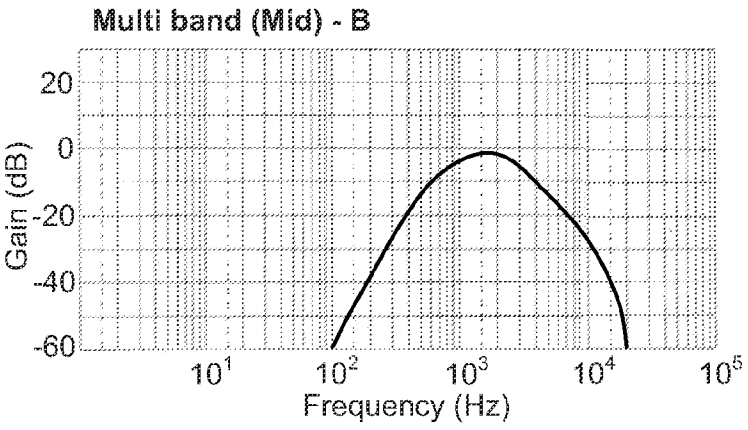
Figure 8C:
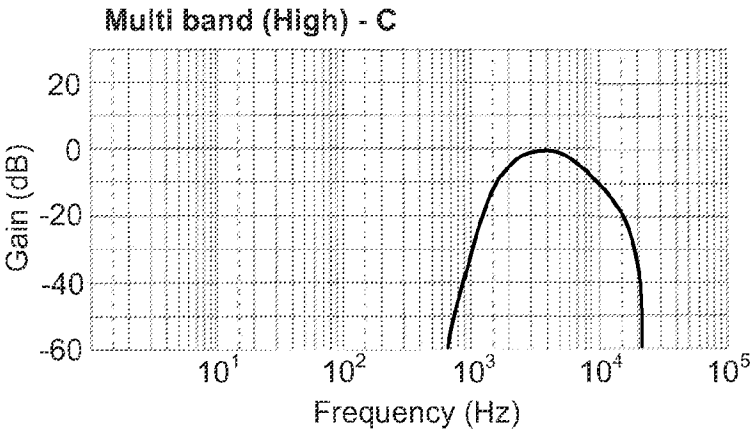
Figure 8D:
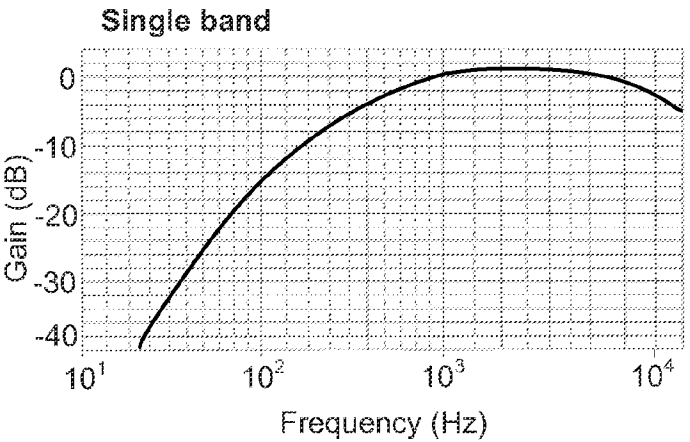

Equal loudness weighting filters 40, 60 may include a modified Fletcher Munson—pink noise weighting filter including an ITU-R 468 weighting contour. Weighting filters 40, 60 may be implemented in any suitable manner and by any suitable means. In one form the response of weighting filters 40, 60 may include a frequency response contour as shown in FIG. 8D for a single band implementation. For multi-band implementations the response of weighting filters 40, 60 may include frequency response contours as shown in FIGS. 8A to 8C for low band A, mid band B and high band C respectively.

RMS detectors 44, 61 may be implemented in any suitable manner and by any suitable means. In one form RMS detectors 44, 61 may be implemented on a digital sound processor such as a Texas Instruments TAS 3108 via Pure Path Studio Software.

The invention described herein is susceptible to variations, modifications and/or additions other than those specifically described and it is to be understood that the invention includes all such variations, modifications and/or additions which fall within the spirit and scope of the above description.

It may be appreciated that a matrix decoder as described herein may be applied to a surround sound system utilizing more than four audio input signals to represent an original sound field. For example using the teachings of the present invention a pair of decoders as described herein may be applied to encode eight audio input signals representing an original sound field into four channel signals and the encoded four channel signals may be decoded into eight audio output signals. Such decoders may be applied to an installation including four pairs of loudspeakers or speaker arrays wherein each loudspeaker or speaker array is arranged at a respective corner of a cube or a rectangular cuboid to define upper and lower planes of four loudspeakers or speaker arrays each, namely four loudspeakers or speaker arrays in the front and four loudspeakers or speaker arrays in the back. The upper plane of loudspeakers or speaker arrays may be vertically separated relative to the lower plane of loudspeakers or speaker arrays by approximately 2-3 m or other suitable distance depending on usable height in an associated listening zone or auditorium.

The encoded four channel signals may be recorded on suitable media such as DVD, BluRay disc or the like and/or broadcast via a HDTV transmission service such as Foxtel that is capable of transmitting at least four channels of audio signals.

The invention claimed is:

1. A decoder for use in a surround sound system wherein at least four audio input signals (FL, FR, RL, RR) representing an original sound field are encoded into two 5 channel signals (L, R) and said encoded two channel signals are decoded into at least four audio output signals (FL', FR', RL', RR') corresponding to said four audio input signals, said encoded two channel signals having an amplitude ratio and a phase relationship, said decoder including:

a perceived loudness filter connected to receive said encoded two channel signals for compensating for variations in perceived loudness relative to frequency associated with said encoded two channel signals due to non linearity in human hearing response at least at some frequencies;

a control unit responsive to the phase relationship of said compensated two channel signals for producing steering signals; and a matrix circuit connected to receive said compensated two channel signals for decoding said encoded two channel signals to produce said audio output signals corresponding to said audio input signals, said matrix circuit including structure responsive to said steering signals for varying at least the amplitude ratio of said encoded two channel signals contained in each of said output signals.

2. A decoder according to claim 1 wherein said perceived loudness filter includes an equal loudness weighting contour.

3. A decoder according to claim 1 wherein said perceived loudness filter includes a pink noise contour.

4. A decoder according to claim 1 wherein said perceived loudness filter includes an ITU-R 468 weighting contour.

5. A decoder according to claim 1 wherein said perceived loudness filter includes an A-weighting contour.

6. A decoder according to claim 1 including an RMS detector connected to receive said two channel signals for determining a root mean square (RMS) value associated with said two channel signals.

7. A decoder according to claim 6 wherein said RMS detector includes structure for applying a first attack time constant and a second decay time constant in determining said RMS value.

8. A decoder according to claim 7 wherein said first attack time constant is substantially faster than said second decay time constant.

9. A decoder according to claim 1 including a further filter connected to receive said two channel signals for adjusting amplitude of said signals to correct for logarithmic sensitivity of human hearing response.

10. A pair of decoders each being according to claim 1 for use in a surround system wherein at least eight audio input signals representing an original sound field are encoded into four channel signals and said encoded four channel signals are decoded into at least eight audio output signals corresponding to said eight audio input signals.

11. A decoding method for use in a surround sound system wherein at least four audio input signals (FL, FR, RL, RR)

representing an original sound field are encoded into two channel signals (L, R) and said encoded two channel signals are decoded into at least four audio output signals (FL', FR', RL', RR') corresponding to said four audio input signals, said encoded two channel signals having an amplitude ratio and a phase relationship, said method including:

in a perceived loudness filter, compensating said encoded two channel signals for variations in perceived loudness relative to frequency associated with said encoded two channel signals due to non linearity in human hearing response at least at some frequencies;

producing steering signals in response to the phase relationship of said compensated two channel signals; and decoding said encoded two channel signals to produce said audio output signals corresponding to said audio input signals by varying at least the amplitude ratio of said encoded two channel signals contained in each of said output signals in response to said steering signals.

12. A method according to claim 11 wherein said compensating is performed by the perceived loudness filter having an equal loudness weighting contour.

13. A method according to claim 12 wherein said perceived loudness filter includes a pink noise contour.

14. A method according to claim 12 wherein said perceived loudness filter includes an ITU-R 468 weighting contour.

15. A method according to claim 12 wherein said perceived loudness filter includes an A-weighting contour.

16. A method according to claim 11 including determining a root mean square (RMS) value associated with said two channel signals.

17. A method according to claim 16 wherein said RMS value is determined via an RMS detector connected to receive said two channel signals for applying a first attack time constant and a second decay time constant.

18. A method according to claim 17 wherein said first attack time constant is substantially faster than said second decay time constant.

19. A method according to claim 11 including adjusting amplitude of said signals to correct for logarithmic sensitivity of human hearing response.

20. A method according to claim 19 wherein said amplitude of said signals is adjusted via a further filter connected to receive said two channel signals.

21. A method according to claim 11 wherein at least eight input signals representing an original sound field are encoded into four channel signals and said encoded four channel signals are decoded into at least eight audio output signals corresponding to said eight audio input signals.

* * * * *